US005458262A

United States Patent [19]

Keller

[11] Patent Number: 5,458,262

[45] Date of Patent: Oct. 17, 1995

[54] METHOD FOR AN ALIGNED ATTACHMENT OF A MIXER TO A CARTRIDGE

[76] Inventor: Wilhelm A. Keller, Obstgartenweg 9, CH-6402 Merlischachen, Switzerland

[21] Appl. No.: 159,370

[22] Filed: Nov. 30, 1993

[30] Foreign Application Priority Data

Nov. 30, 1992 [EP] European Pat. Off. ..... 92810929

[51] Int. Cl.[6] ..... B67D 5/60

[52] U.S. Cl. ..... 222/135; 222/459; 222/570

[58] Field of Search ..... 222/135, 136, 222/137, 326, 327, 566, 568, 570, 459, 145; 366/336, 340; 206/219, 384; 285/396, 361, 402

[56] References Cited

U.S. PATENT DOCUMENTS

| | | | |
|---|---|---|---|
| 1,549,858 | 8/1925 | Evans | 222/568 |
| 3,388,842 | 6/1968 | Costa | 222/566 |
| 3,390,814 | 7/1968 | Creighton, Jr. et al. | 222/137 |
| 4,538,920 | 9/1985 | Drake | 222/137 X |
| 4,653,676 | 3/1987 | Stull | 222/566 |
| 4,767,026 | 8/1988 | Keller et al. . | |
| 4,771,919 | 9/1988 | Ernst | 222/145 X |
| 4,907,725 | 3/1990 | Durham | 222/459 X |
| 4,949,873 | 8/1990 | Maeder | 222/135 |
| 4,974,756 | 8/1990 | Pearson et al. | 222/137 |
| 4,995,540 | 2/1991 | Colin et al. | 222/137 X |
| 5,033,650 | 7/1991 | Colin et al. | 222/459 X |
| 5,080,262 | 1/1992 | Herold et al. | 222/459 X |
| 5,228,599 | 7/1993 | Keller . | |

FOREIGN PATENT DOCUMENTS

| | | | |
|---|---|---|---|
| 228588 | 3/1959 | Australia | 222/570 |
| 232733 | 10/1989 | European Pat. Off. . | |
| 8904246 | 8/1989 | Germany . | |

*Primary Examiner*—Andres Kashnikow
*Assistant Examiner*—Lisa Douglas
*Attorney, Agent, or Firm*—Marks & Murase

[57] ABSTRACT

A method and apparatus for attaching in alignment a mixer to a dispensing cartridge. A ledge or recess is provided on the mixer while a corresponding groove or nose is provided at the dispensing end of the cartridge. A mixing element such as a mixing helix is aligned within a guide in the mixer housing. The mixing helix further includes an extended wall having a slot which matches a separating wall in the dispensing cartridge. When the mixer is coupled to the dispensing cartridge, the mixer and its mixing element are aligned simply and safely relative to the dispensing cartridge.

8 Claims, 3 Drawing Sheets

METHOD FOR AN ALIGNED ATTACHMENT OF A MIXER TO A CARTRIDGE

BACKGROUND OF THE INVENTION

The present invention refers to a method for an aligned attachment of a mixer to a cartridge, and further refers to a cartridge, more particularly a multiple cartridge, and a mixer for carrying out said method. It may be advantageous for various reasons to attach the mixer to the cartridge according to a determined orientation. For example, if the dispensing end of the mixer is provided with means in order to give the extruded material a particular shape or position, e.g. a band or a triangular ribbon, it is advantageous to define the orientation of the mixer with respect to the cartridge precisely.

A static mixer which is attachable to a double cartridge in a determined position is described in U.S. Pat. No. 4,538,920. Said determined position of the mixer with respect to the cartridge is obtained by a bayonet lock involving an approximate 90° turn of the mixer in the flange of the cartridge.

European Patent 232,733 discloses a mixer which is attachable to a double cartridge by means of a bayonet lock.

SUMMARY OF THE INVENTION

From this background, it is the object of the invention to provide a method for an aligned attachment of the mixer to a cartridge, and means for carrying out said method, which is not limited to an attachment by means of a bayonet lock but are generally applicable. This object is attained by a method wherein the aligning means of said mixer are brought into engagement with the corresponding aligning means of said cartridge outlet in the process of attaching said mixer to the dispensing end of said cartridge, and said mixer is secured; and by a cartridge and a mixer for carrying out said method, wherein said aligning means of said mixer comprise at least one ledge engaging in a corresponding groove of the neck of the cartridge coupling or at least one recess receiving a nose of the cartridge coupling; and furthermore, by a multiple cartridge and a mixer for carrying out said method, wherein said aligning means of the mixer include a slot or a portion in an extended wall of the first mixing helix, the separating wall between the outlets of the storage cylinders matching said slot or said portion.

In addition, it may be advantageous if the mixer element consisting of mixing helixes, or its inlet portion, respectively, is exactly aligned with respect to the outlet end of the cartridge in order to obtain an optimal mixing of the substances in the mixer. This applies especially to double or multiple cartridges, where several components have to be mixed together. Including such aligning means for the inlet portion of the mixing element, allows alignment of all parts which are important for the dispensing operation.

The invention is explained in more detail hereinafter with reference to a drawing of embodiments.

BRIEF DESCRIPTION OF THE DRAWINGS

In FIG. 1, one of the aligning means according to the invention of a mixer housing 16 is shown, i.e. at least one ledge 15. In FIG. 2, said ledge slides (or engages) within a groove 11 in threaded portion 12 which is arranged on the outlet nozzle 13 of a double cartridge comprising two storage cylinders 17 and 18. If two ledges 15, 15*a* are provided on the mixer housing, two grooves must be provided in threaded portion 12. It is understood in this context that a single ledge and groove result in an unequivocal position of the mixer housing, whereas two ledges and two grooves allow two positions at 180° from each other. Nozzle 13 need not necessarily be threaded, in which case said grooves will be sunk in the neck.

FIG. 7 shows another embodiment in which dispensing nozzle 29 of a double cartridge is provided between threaded portion 26 and its end with a nose 30 which engages in a corresponding cutout 28 of mixer housing 27. As shown in the drawing, said nose does not extend to the very edge in order to allow the latter to engage completely tightly in the shoulder at the transition between the cylindrical and the conical portion of the mixer housing. In analogy to the aligning means formed by ledges and grooves, two noses may be provided on the cartridge nozzle and two cutouts on the mixer housing as well, in order to allow two positions instead of one unequivocal alignment. In this case also, threaded portion 26 is not always necessary in order to secure the mixer to the cartridge.

Figure 3:
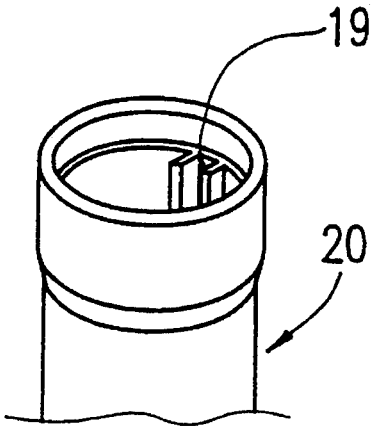
FIG. 3 shows a first embodiment with aligning means provided within the mixer housing.
Figure 2:
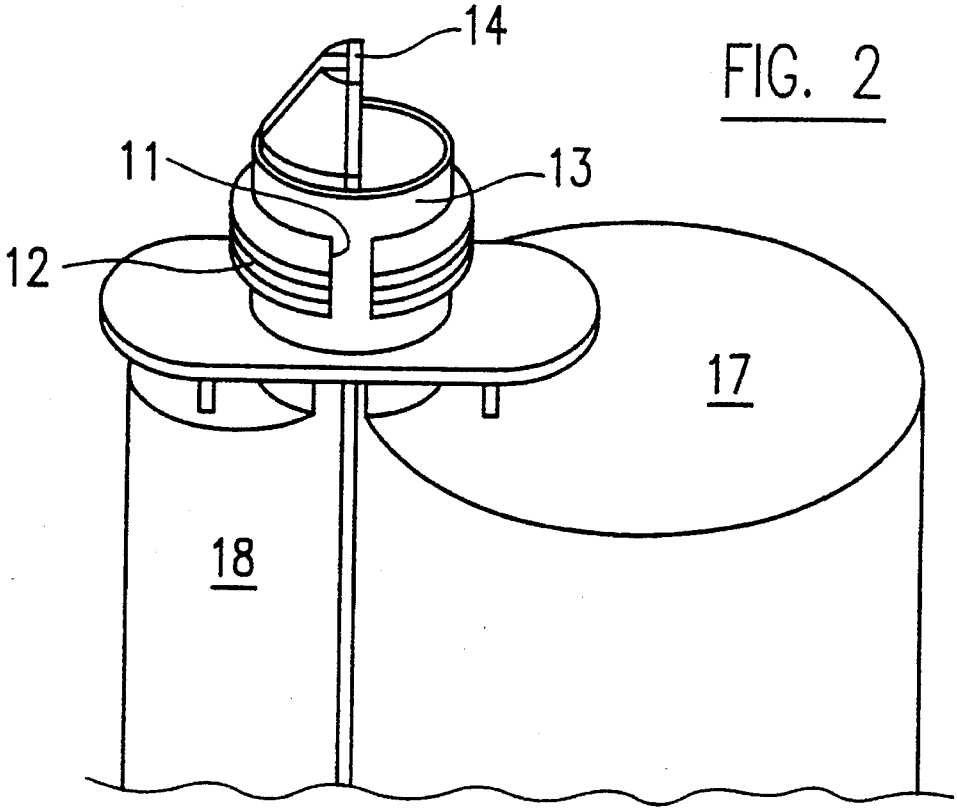
FIG. 2 shows the outlet end of an associated double cartridge comprising aligning means which are complementary to said means of the mixer housing.

In these embodiments, only the mixer housing is aligned with respect to the cartridge. This is also true in the embodiment of FIG. 3. On the inner wall of mixer housing 20, one guide or two guides are provided, in each of which one side of a correspondingly shaped separating wall of the outlet nozzle of a double cartridge engages, said separating wall being e.g. shaped like separating wall 21 of cartridge 22 according to FIG. 5, which comprises two storage cylinders 23 and 24. In this case, however, groove 25 in threaded portion 26 is not necessary. The two double cartridges 17,18 and 22 are different from each other in that the storage cylinders 17,18 do not have the same cross-section.

The main purpose of this kind of alignment is to align the mixer housing with respect to its outlet end in an unambiguous position or in two determined positions in the case where said outlet end has a certain configuration, i.e. if it is e.g. larger than it is high or triangular and thus is intended to be applied in a certain orientation.

Figure 1:
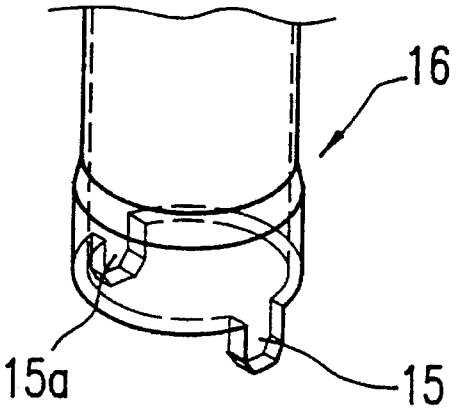
FIG. 1 shows the cartridge end of a mixer housing comprising the aligning means of the invention.
Figure 4:
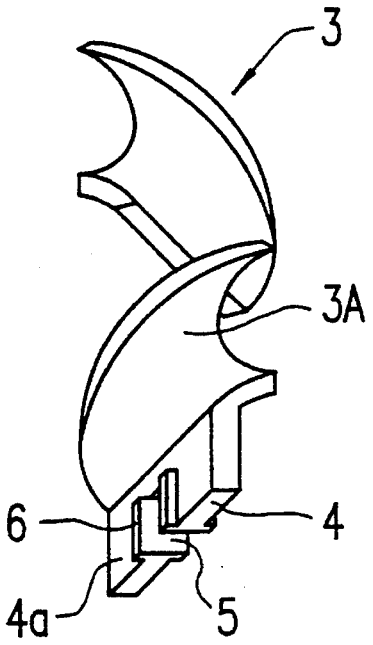
FIG. 4 shows a second embodiment with aligning means provided on a mixer element.

In many applications it is advantageous to align the mixer element, i.e. its inlet portion, exactly perpendicularly with respect to the separating wall of the cartridge in order to obtain a better mixing of the components. In FIG. 4, the inlet portion of a mixer element I is shown, said inlet portion being insertable in a mixer housing, e.g. according to FIG. 1, but without said ledges. Mixer element 1 consists of a number of mixing helixes 3 which are arranged perpendicularly to each other. The first mixing helix 3A at the inlet of the mixer is provided with an extended wall 4 comprising a slot 5. At the location of said slot, said wall may comprise guiding ledges 6.

When using double cartridges having storage cylinders whose volume ratio or cross-sectional ratio greatly differs from 1:1, the extended wall of the first mixing helix at the end of the slot can be omitted on one side, e.g. at 4*a*.

Figure 5:
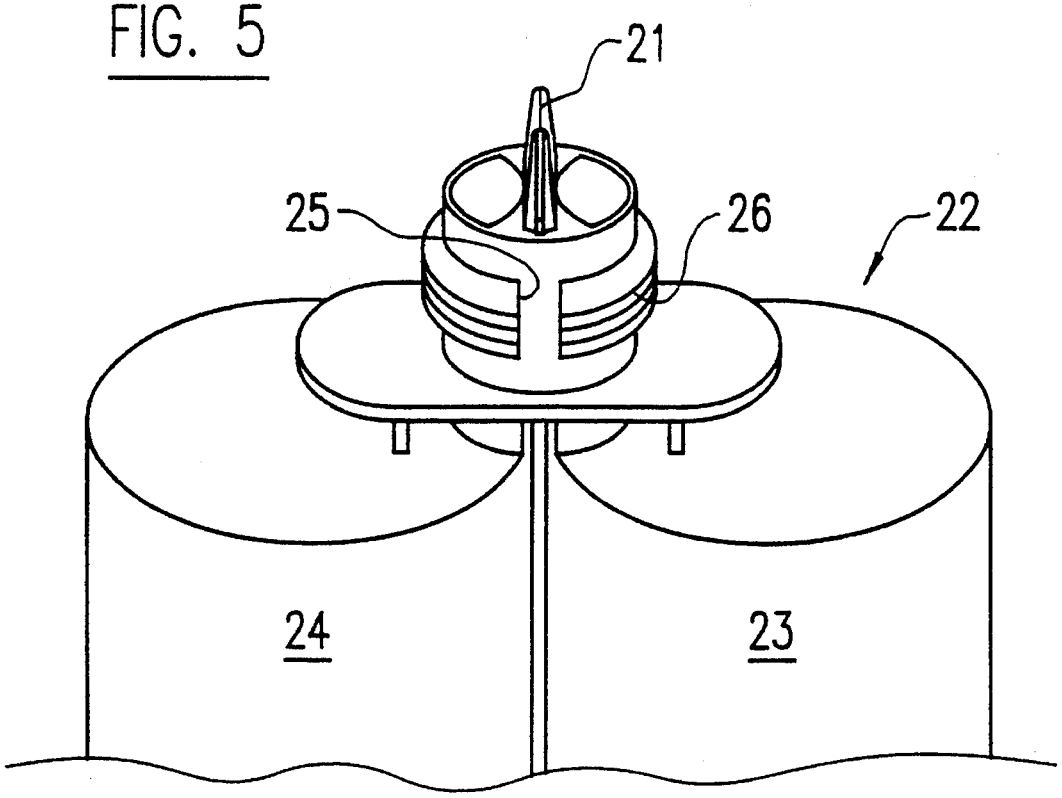
FIG. 5 shows an alternative embodiment of an outlet end of a double cartridge.

When a mixer of this kind is attached e.g. to a cartridge according to FIG. 5, separating wall 21 of the cartridge engages in slot 5 of the mixer elements, so that the mixer is orientable in two positions. In order to determine an unequivocal position, a ledge 15 is more suitable. The main purpose of the alignment by the means of FIG. 4 in this embodiment is a precisely perpendicular alignment of the inlet portion of the mixing helixes with the separating wall of the cartridge. In the mixer according to European Patent 232,733, by contrast, the wall of the first mixing helix is aligned exactly in parallel to the separating wall.

If it is merely intended to attach the mixer, i.e. the mixer element and more particularly its inlet element, in a certain position with respect to the cartridge, it would be sufficient simply to insert and secure the mixer element in the housing in some manner, since the alignment of the mixer with respect to the cartridge is effected by the mixer element itself. In such cases as mentioned in the introduction, however, it is advantageous or even necessary also to align the mixer housing with respect to the cartridge, so that the mixer element will be secured in the mixer housing in a determined position.

Figure 6:
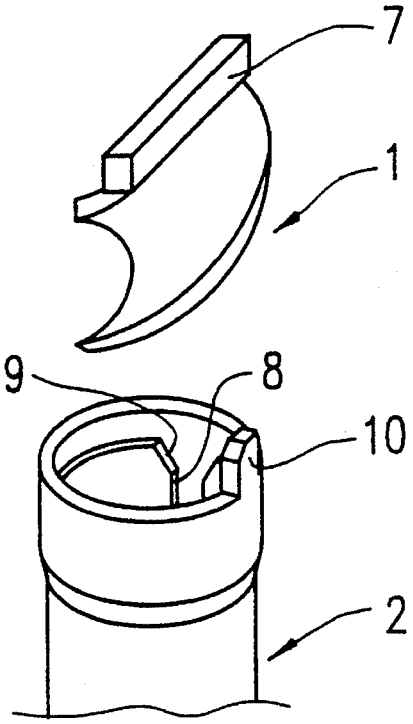
FIG. 6 shows a mixer element and a mixer housing before their assembly.
Figure 7A:
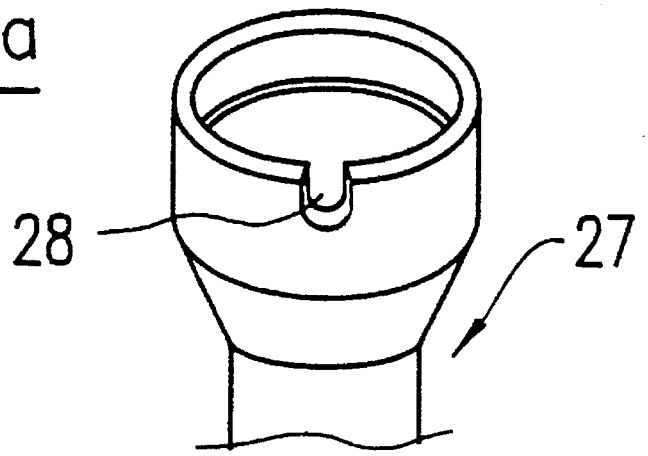
FIGS. 7(*a*) and 7(*b*) show another embodiment of aligning means provided on the mixer housing and on the cartridge.
Figure 7B:
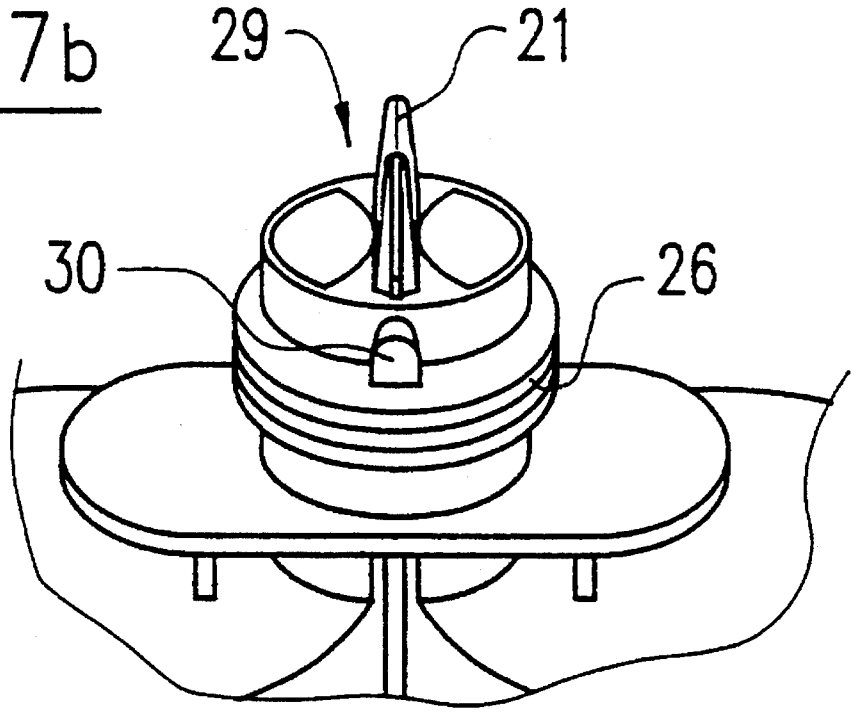

In both above-mentioned documents, the mixer element is inserted in the housing in a defined way. The alignment of the mixer element in the housing may e.g. be effected according to FIGS. 6 and 7 by two grooves 8 which have a funnel-shaped enlargement 9 at the top in order to facilitate the insertion of the mixer element. To this end, the inlet portion of the mixer element preferably comprises a web 7 which is a little larger than the mixer helixes and engages in grooves 8 on both sides. The alignment of the mixer and its unequivocally positioned mixer element with respect to the cartridge is then basically effected by the above-mentioned means, i.e. for example by one or two ledges of the mixer housing or by one or two noses of the cartridge nozzle, by the use of a slot or a shoulder on the extended wall of the first mixing helix of the mixing element, or by guides in the mixer housing. In the latter embodiment, a groove 8 may be provided on one side of the mixer housing, and a guide 19 on the other side.

It follows from the drawing and from the preceding description that the mixer element respectively its inlet portion, the mixer housing, and the outlet openings of the cartridge, i.e. the separating wall between the two outlet openings are all in a determined relationship to each other. Suitably, separating wall 14 between the two outlet openings of the cartridge is perpendicular to the connecting line between the two storage cylinder centers, and groove 11 in the threaded portion of the outlet nozzle is also aligned in the same direction as said separating wall which is moreover disposed in the extension of the space between the two storage cylinders. Slot 5 in wall 4 of the inlet portion of the mixer element is shaped such that it matches separating wall 14 of the outlet nozzle and wall 4 is perpendicular to separating wall 14 when the mixer is attached to the outlet nozzle of the cartridge. Accordingly, ledge 10, or the two ledges 15, are offset by 90° with respect to grooves 8 in the mixer housing which receive the sides of wall 4 of the mixer element. The same applies, in analogy, to nose 30 and cutout 28.

Of course, if the first mixing helix wall is aligned in parallel to the separating wall of the cartridge outlet, the slot or the shoulder of the inlet portion cannot be used as an aligning means, and another aligning means must be provided.

Ledge 10 may serve not only to guide the mixer on the cartridge, but also as an indication of the position of the mixer housing, if the outlet of the mixer must be aligned in a certain position with respect to the cartridge. After attaching the mixer to the cartridge, it is secured by a non-represented coupling nut which is screwed onto threaded portion 12, also in the case of nose 30 and cutout 28.

Although these aligning means are most advantageous for multiple cartridges, especially for double cartridges, they are not limited thereto. Moreover, the storage cylinders can have equal or different volumes and cross-sections.

I claim:

1. A method for an aligned attachment of a mixer to a cartridge arrangement, comprising the steps of:

forming a first aligning means in a mixer having a first mixing helix, said first aligning means including a slot or a portion in an extended wall of the first mixing helix;

forming a second aligning means in the form of a separating wall disposed between outlets of storage cylinders at a dispensing end of said cartridge arrangement, said separating wall corresponding to said slot or portion of the first aligning means; and coupling the first and second aligning means by bringing the slot or portion of the first aligning means of said mixer into engagement with the corresponding separating wall of the second aligning means at the dispensing end of said cartridge arrangement, whereby said mixer is secured.

2. An apparatus for aligning a cartridge arrangement and a mixer, comprising a first aligning means disposed in said mixer; and a second aligning means disposed at a dispensing end of said cartridge arrangement corresponding to said first aligning means; wherein the first aligning means of said mixer is brought into engagement with the corresponding second aligning means at the dispensing end of said cartridge arrangement when said mixer is secured;

wherein said cartridge arrangement includes a separating wall disposed between outlets of storage cylinders and said mixer includes a first mixing helix, wherein said first aligning means of the mixer includes a slot or a portion in an extended wall of the first mixing helix, and said corresponding second aligning means comprises the separating wall between the outlets of the storage cylinders which matches said slot or said portion.

3. The apparatus for aligning a cartridge arrangement and a mixer according to claim 2, wherein said cartridge arrangement comprises a multiple cartridge for dispensing the contents of multiple storage containers to the mixer.

4. The apparatus for aligning a cartridge arrangement and a mixer according to claim 2, wherein said first aligning means of said mixer further comprises at least one guide into which the separating wall between the outlets of said storage cylinders fits.

5. The apparatus for aligning a cartridge arrangement and a mixer according to claim 2, wherein said mixer has a housing and includes a mixing element aligned within the mixer housing.

6. An apparatus for aligning a cartridge arrangement and a mixer, comprising:

a first aligning means disposed in said mixer; and a second aligning means disposed at a dispensing end of said cartridge arrangement corresponding to said first aligning means;

wherein the first aligning means of said mixer is brought into engagement with the corresponding second aligning means at the dispensing end of said cartridge arrangement when said mixer is secured;

wherein said mixer has a housing and includes a mixing element aligned within the mixer housing; and wherein said mixer element has an inlet portion with at least one projecting portion and said mixer housing comprises at least one groove in which a corresponding projecting portion of the inlet portion of said mixer element is inserted.

7. The apparatus for aligning a cartridge arrangement and a mixer according to claim 2, wherein said first aligning means of said mixer comprises at least one ledge and said second aligning means comprises at least one corresponding groove on a neck of the dispensing end of said cartridge arrangement.

8. The apparatus for aligning a cartridge arrangement and a mixer according to claim 2, wherein said first aligning means of said mixer comprises at least one recess and said second aligning means comprises at least one corresponding nose.

* * * * *